US006276978B1

(12) United States Patent
Chen

(10) Patent No.: US 6,276,978 B1
(45) Date of Patent: Aug. 21, 2001

(54) FIN WITH A HARMLESS FOOT POCKET

(76) Inventor: Chien-Rung Chen, PO Box 82-144, Taipei (TW)

( * ) Notice: Subject to any disclaimer, the term of this patent is extended or adjusted under 35 U.S.C. 154(b) by 0 days.

(21) Appl. No.: 09/748,253

(22) Filed: Dec. 27, 2000

(51) Int. Cl.[7] ..... A63B 31/08
(52) U.S. Cl. ..... 441/64
(58) Field of Search ..... 441/61–64

(56) References Cited

U.S. PATENT DOCUMENTS 3,178,738 * 4/1965 Trell ..... 441/64
3,239,857 * 3/1966 Gwynne ..... 441/64
4,954,111 * 9/1990 Cressi ..... 441/64
5,108,328 * 4/1992 Hull ..... 441/64

* cited by examiner

*Primary Examiner*—Jesus D. Sotelo
(74) *Attorney, Agent, or Firm*—A & J

(57) ABSTRACT

A fin is formed of a foot pocket that has a slit extended from one side to another side of the foot pocket along a joint of the foot pocket and a blade of the fin, so that a front part of the foot pocket forms a movable protective flap. The movable protective flap allows a diver to easily push it open with toes and to exert strength via instep against the foot pocket during kicking water. The movable protective flap provides sufficient space for toes to move in the foot pocket without being compressed while protects the diver's foot against rocks, coral reefs and the like and therefore allows the diver to kick water more powerfully. The movable protective flap also eliminates hard and sharp edge of the foot pocket to protect the diver's foot against cut, bruised or swollen instep that is in contact with the foot pocket.

4 Claims, 3 Drawing Sheets

FIN WITH A HARMLESS FOOT POCKET

FIELD OF THE INVENTION

The present invention relates to a fin, and more particularly to a fin having a foot pocket that on the one hand comfortably covers and protects a diver's toes from harm and on the other hand enables the diver to force his instep against the foot pocket while kicking water.

BACKGROUND OF THE INVENTION

Conventional fins can be generally divided into two types, namely, a fin 10 with closed foot pocket 40, as shown in FIG. 1, and a fin 20 with open foot pocket 40, as shown in FIG. 2. In both types, the foot pocket 40 is integrally connected to a blade 30 of the fin 10, 20. The closed foot pocket 40 of the fin 10 has a front portion 41 that is completely connected to the blade 30 without any opening between them and therefore encloses toes of a diver wearing the fin 10 in the foot pocket 40. On the other hand, the open foot pocket 40 of the fin 20 has a front opening 42 between the foot pocket 40 and the blade 30 to expose the diver's toes.

As known by most people, in skin diving or other types of diving, the diver moves forward under water when he or her alternately swings two legs up and down to kick water. The diver's strength is transferred from thighs via shanks to insteps and toes, enabling insteps and toes to force against the foot pockets 40 and thereby bring the blades 30 to downward move against water. Please refer to FIG. 3. For a diver wearing fins 10 with closed foot pockets 40, when one of his or her two legs is moved downward to kick water, the leg's strength is transferred to toes 43, forcing the same to press against the foot pocket 40 at an inner side of the front portion 41 thereof and bring the blade 30 to downward move against water. It is known that toes are the most vulnerable portions in human's feet. Improperly or overly applying a force with toes tends to cause tiredness and pain of feet. When the toes 43 forcefully press against the closed foot pocket 40, the diver's sole arches to easily cause sprained toe joints as well as cramped foot and calf.

Please now refer to FIG. 4. The open foot pocket 40 of the fin 20 allows toes 43 to expose from the front opening 42 thereof. When the diver wears fins 20 with open foot pockets 40, his or her leg strength of the downward moved leg is transferred to an instep 44 of that leg, making the instep 44 a point of applying force. The instep 44 applies a force on the foot pocket 40 that transfers the force to the blade 30 to complete the movement of kicking water. Since the instep 44 is structurally stronger than toes 43, it is more advantageous to move the blade 30 with the instep 44 than toes 43. The fin 20 with open foot pocket has, however, a drawback of dangerously exposing toes 43 and a part of the instep 44 from the front opening 42 of the foot pocket 40 to rocks, coral reefs, sea urchins and the like under sea, resulting in cut wound and/or puncture wound at these areas. Moreover, the front opening 42 of the open foot pocket 40 has a hard and sharp front edge 45 that would be inevitably in contact with and abrade or otherwise compress the instep 44 at some fixed areas thereof when the latter exerts force against the foot pocket 40, resulting in swollen, blistered, bruised skin and/or soreness and stiffness of the instep 44. Such harms made by the open foot pockets 40 to the diver's insteps prevent the diver from kicking water with full strength and make diving less interesting.

SUMMARY OF THE INVENTION

It is a primary object of the present invention to provide a fin with a harmless foot pocket to eliminate the drawbacks of the conventional fin with closed or open foot pocket in causing tired and sore toes, sprained toe joints, cramped feet and calves, and wounded skin and cartilage at instep.

The fin with a harmless foot pocket according to the present invention mainly includes a foot pocket that has a slit extended from one side to another side of the foot pocket along a joint of the foot pocket and a blade of the fin, so that a front part of the foot pocket forms a movable protective flap. The movable protective flap allows a diver to easily push it open with toes and to exert strength via instep against the foot pocket during kicking water. The movable protective flap is large enough to provide sufficient space for toes to move in the foot pocket without being compressed while protects the diver's foot against rocks, coral reefs and the like and therefore allows the diver to kick water more powerfully. The movable protective flap also eliminates hard and sharp edge of the foot pocket to protect the diver's foot against cut, bruised or swollen instep that is in contact with the foot pocket.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
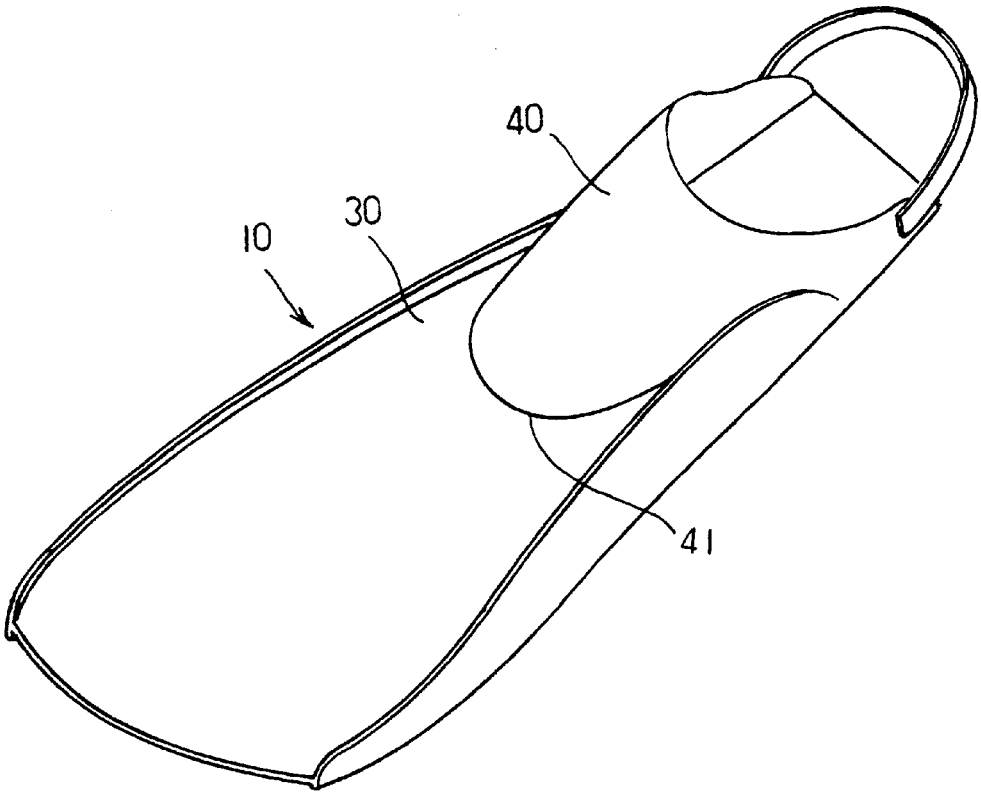
FIG.1 (Prior Art)
FIG. 1 is a perspective of a conventional fin with a closed foot pocket.
Figure 2:
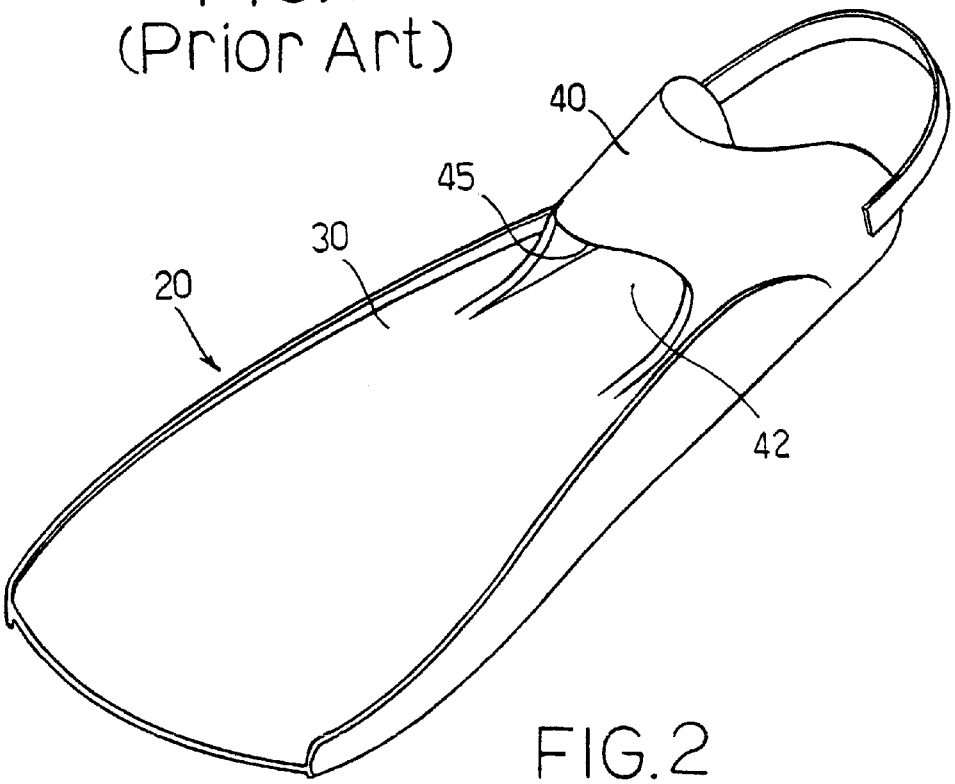
FIG.2 (Prior Art)
FIG. 2 is a perspective of a conventional fin with an open foot pocket.
Figure 3:
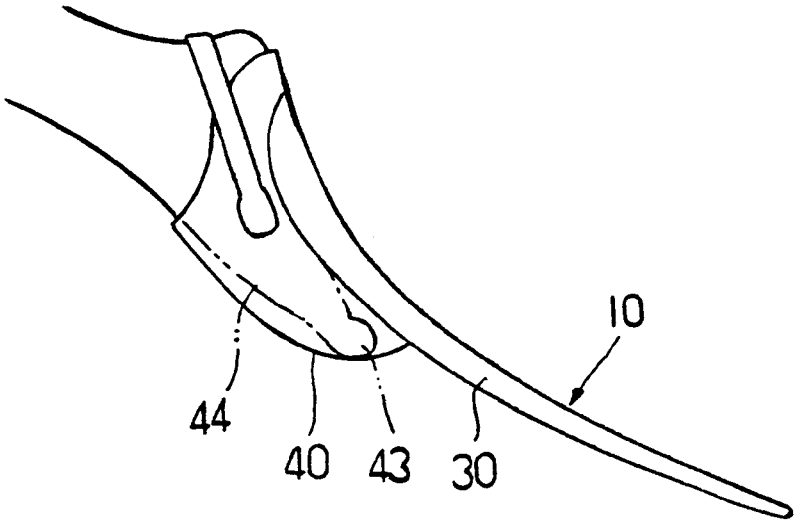
FIG. 3 (Prior Art)
FIG. 3 is a side view showing how a diver wearing the fin of FIG. 1 forces his toes against the foot pocket while kicking water.
Figure 4:
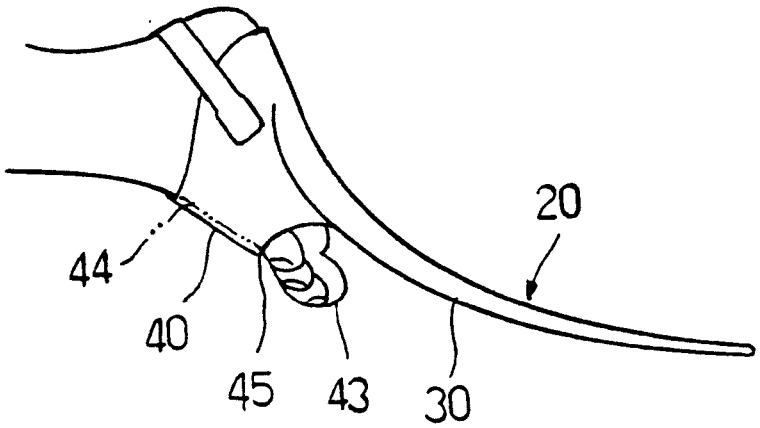
FIG. 4 (Prior Art)
FIG. 4 is a side view showing how a diver wearing the fin of FIG. 2 forces his instep against the foot pocket while kicking water.
Figure 5:
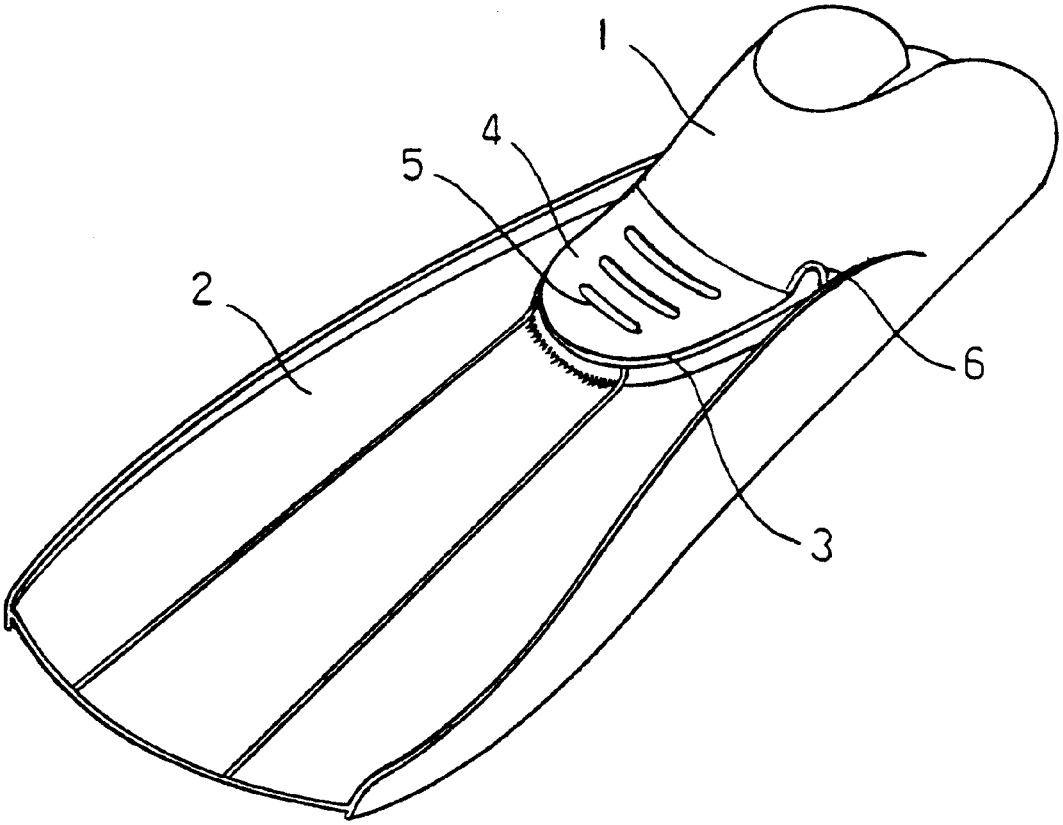
FIG. 5 is a perspective of a fin having a harmless foot pocket according to the present invention.
Figure 6:
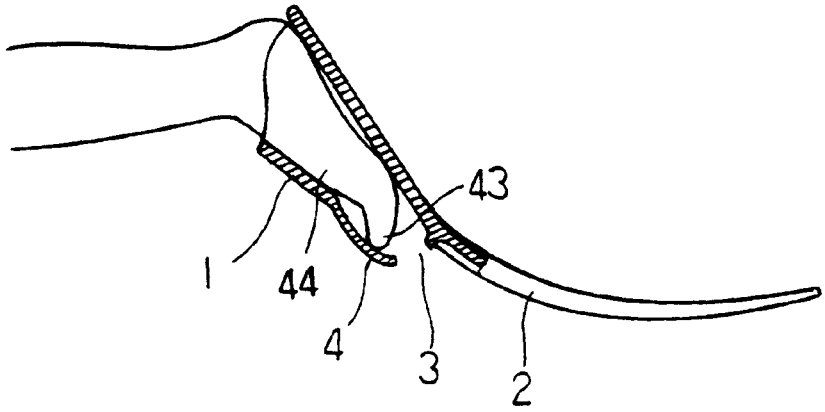
FIG. 6 is a partially sectioned side view showing how a diver wearing the fin of FIG. 5 pushes a movable protective flap of the foot pocket open with toes and forces his instep against the foot pocket while kicking water.

Please refer to FIGS. 5 and 6 in which a fin with a harmless foot pocket according to the present invention is shown. The fin mainly includes a foot pocket 1 that has a substantially semi-circular slit 3 extended from a predetermined point at one side to another predetermined point at the other side of the foot pocket 1 along a joint of the foot pocket 1 and a blade 2 of the fin, such that a front part of the foot pocket 1 forms a movable protective flap 4 integrally connected to the foot pocket 1. The movable protective flap 4 enables the foot pocket 1 to function, on the one hand, like a closed foot pocket 40 on the fin 10 to protectively cover the diver's toes 43 and, on the other hand, like an open foot pocket 40 on the fin 20 to allow exposure of toes 43 to external environment without being compressed.

When a diver wearing fins of the present invention alternately forces two legs downward to kick water and thereby moves forward under water, his or her toes 43 of the downward moved leg would naturally and automatically push open the movable protective flap 4 and exert force via the instep 44 against the foot pocket 1 behind the movable protective flap 4. Therefore, the foot pocket 1 not only provides sufficient space for toes 43 to move therein, but also allows the diver's instep 44 to exert more powerful strength against the blade 2 for the latter to downward move against water and push the diver forward under water. The movable protective flap 4 is large enough to normally protect the instep 44 and toes 43 against cut wound, puncture wound, and many other potential dangers when the diver is under water. The diver's instep 44 and toes 43 are completely located below the movable protective flap 4 and not in contact with any edge of the movable protective flap 4. The instep 44, when exerting force against the foot pocket 1 to move the blade 2 downward, is protected from undesired compression and abrasion due to the edge of the protective flap 4 and therefore enables the diver to continue kicking water for a prolonged time.

In an embodiment of the present invention, the movable protective flap 4 is provided with a plurality of air vents 5 of any shape. Air vents 5 increase a softness of the protective flap 4 and facilitate good water convection in the foot pocket 1 and draining of water from the foot pocket 1 to eliminate possible vacuum sucking effect in the foot pocket 1 when the diver pulls his or her foot out of the foot pocket 1, particularly when the diver intends to end diving or is in an emergent condition during diving.

In implementing the present invention, the movable protective flap 4 may be made of a material thinner or softer than that for making the foot pocket 1, so that the movable protective flap 4 could be more easily pushed open with toes 43. Moreover, ribs 6 of suitable shape and dimensions may be provided at two ends of the slit 3 to prevent the movable protective flap 4 from easily breaking and separating from the foot pocket 1 at the two ends of the slit 3.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A fin with a harmless foot pocket, comprising a foot pocket integrally connected to a blade of said fin, said foot pocket being characterized in that it has a slit extended from a predetermined point at one side to another predetermined point at the other side of said foot pocket along a joint of said foot pocket and said blade, such that a front part of said foot pocket forms a movable protective flap integrally connected to said foot pocket; and said movable protective flap allowing a diver to easily push it open with toes and to exert force via an instep against an area of said foot pocket behind said movable protective flap when the diver forces one leg wearing said fin downward to kick water.

2. A fin with a harmless foot pocket as claimed in claim 1, wherein said movable protective flap is made of a material thinner or softer than that for making said foot pocket to enable easy pushing open of said movable protective flap with toes.

3. A fin with a harmless foot pocket as claimed in claim 1, wherein said movable protective flap is provided with a plurality of air vents of any shape to enable good water convection in said foot pocket and good draining of water from said foot pocket and thereby avoids a vacuum sucking effect in said foot pocket when a diver pulls his leg out of said foot pocket.

4. A fin with a harmless foot pocket as claimed in claim 1, wherein said movable protective flap is provided with ribs at two ends of said slit to protect said movable protective flap from easily breaking and separating from said foot pocket at the two ends of said slit.

* * * * *